US008749596B2

(12) United States Patent
Haas et al.

(10) Patent No.: US 8,749,596 B2
(45) Date of Patent: Jun. 10, 2014

(54) DISPLAY DEVICE BASED ON PIXELS WITH VARIABLE CHROMATIC COORDINATES

(75) Inventors: Gunther Haas, Saint-Egrève (FR); David Vaufrey, Grenoble (FR); Olivier Billoint, Grenoble (FR)

(73) Assignee: Commissariat a l'energie Atomique et aux Energies Alternatives, Paris (FR)

( * ) Notice: Subject to any disclaimer, the term of this patent is extended or adjusted under 35 U.S.C. 154(b) by 642 days.

(21) Appl. No.: 12/988,657

(22) PCT Filed: May 6, 2009

(86) PCT No.: PCT/FR2009/000533

§ 371 (c)(1),
(2), (4) Date: Oct. 20, 2010

(87) PCT Pub. No.: WO2009/141530

PCT Pub. Date: Nov. 26, 2009

(65) Prior Publication Data

US 2011/0037791 A1 Feb. 17, 2011

(30) Foreign Application Priority Data

May 13, 2008 (FR) ..... 08 02584

(51) Int. Cl.
*G09G 5/10* (2006.01)

(52) U.S. Cl.
USPC ..... 345/690; 345/212; 313/504

(58) Field of Classification Search
USPC ..... 313/483–512; 345/76–83, 204–213, 345/690–697
See application file for complete search history.

(56) References Cited

U.S. PATENT DOCUMENTS

| | | | | |
|---|---|---|---|---|
| 3,683,365 | A * | 8/1972 | Martin | 345/467 |
| 5,773,130 | A | 6/1998 | So et al. | |
| 8,279,203 | B2 * | 10/2012 | Akimoto et al. | 345/204 |
| 2004/0095168 | A1 | 5/2004 | Miyazawa | |
| 2005/0243077 | A1 | 11/2005 | Chung et al. | |
| 2006/0139251 | A1 * | 6/2006 | Morosawa et al. | 345/76 |
| 2007/0075627 | A1 * | 4/2007 | Kimura et al. | 313/503 |

(Continued)

FOREIGN PATENT DOCUMENTS

| | | |
|---|---|---|
| EP | 1 148 466 A2 | 10/2001 |
| WO | WO 98/59382 A1 | 12/1998 |

(Continued)

OTHER PUBLICATIONS

International Search Report for International Patent Application No. PCT/FR2009/000533, mailed on Oct. 16, 2009.

*Primary Examiner* — Abbas Abdulselam
*Assistant Examiner* — Gerald Oliver
(74) *Attorney, Agent, or Firm* — Oliff PLC

(57) ABSTRACT

A pixel with variable chromatic coordinates comprises a plurality of color sub-pixels consisting of a light emitter and a color filter. The light emitters are identical and have an emission spectrum that is able to be modulated according to their supply voltage and/or current. The pixel control circuit supplies each color sub-pixel with a supply voltage and/or current dependent on the color of the sub-pixel for its emission spectrum to approximate the transmission spectrum of the associated color filter. Control means enable the application time of the supply voltage and/or current to be modified according to the color of the sub-pixel to obtain a predetermined mean luminance during a predetermined period.

8 Claims, 5 Drawing Sheets

(56) References Cited

U.S. PATENT DOCUMENTS

| | | | | |
|---|---|---|---|---|
| 2007/0228938 | A1* | 10/2007 | Hatwar et al. | 313/504 |
| 2008/0088769 | A1* | 4/2008 | Kim et al. | 349/61 |
| 2008/0185971 | A1 | 8/2008 | Kinoshita | |
| 2009/0033212 | A1* | 2/2009 | Ahn et al. | 313/504 |
| 2009/0102352 | A1* | 4/2009 | Cok et al. | 313/498 |
| 2009/0109248 | A1* | 4/2009 | Huber et al. | 345/694 |
| 2010/0276671 | A1* | 11/2010 | Sarma | 257/40 |
| 2011/0050666 | A1* | 3/2011 | Inoue et al. | 345/211 |

FOREIGN PATENT DOCUMENTS

| | | | |
|---|---|---|---|
| WO | WO 2005/069265 | A1 | 7/2005 |
| WO | WO 2005/106836 | A1 | 11/2005 |
| WO | WO 2008/040318 | A1 | 4/2008 |

* cited by examiner

DISPLAY DEVICE BASED ON PIXELS WITH VARIABLE CHROMATIC COORDINATES

BACKGROUND OF THE INVENTION

The invention relates to a display device based on pixels with variable chromatic coordinates comprising a plurality of color sub-pixels each comprising a light emitter formed by an organic light-emitting diode and a color filter, the chromatic coordinates of the pixel being determined periodically and the light emitters being identical.

STATE OF THE ART

In color display systems, the color of each pixel is made up from three primary colors. The CIE 1931 standard can for example be used to define any color visible to the human eye from three standard primary colors constituted by a precise shade of blue (B), red (R) and green (G). With this standard, all the shades of color accessible to the human eye are defined by precise chromatic coordinates which each correspond to a particular distribution of the standard primary colors.

In conventional manner, a pixel is defined by its color and its luminance, i.e. by its visible light intensity. The luminance and chromatic coordinates of a pixel with variable chromatic coordinates are thus redefined periodically according to the image to be displayed.

In conventional manner, a high-definition display system is obtained by means of a very high density of sub-pixels, each pixel comprising a sub-pixel of each primary color.

However light-emitting materials, and in particular organic materials, are difficult to pattern. It is therefore generally chosen to use a continuous white light emitting layer for the emitters, i.e. an emitting layer which is common to all the sub-pixels. For each sub-pixel, the continuous white light emitting layer is associated with a specific color filter, which depends on the color to be obtained for the sub-pixel considered.

As illustrated in FIG. 1, in conventional manner, a pixel 1 with variable chromatic coordinates is made up of three color sub-pixels 2 which each emit a primary color. Each sub-pixel 2 comprises a light-emitting diode 3 formed in the white light emitting layer and controlled by two specific electrodes (not shown) which are arranged on each side of the emitting layer. Each sub-pixel is associated with a color filter 4 which only lets the desired primary color pass. Conventionally, the white light emitting layer is formed in continuous manner on a first set of electrodes. The second set of electrodes is then made on this emitting layer. The light-emitting diodes 3 of the different sub-pixels are thus identical.

In conventional manner, variation of the chromatic coordinates of the pixel is performed periodically by modulating its primary color distribution. This primary color distribution modulation results in practice in modulation of the light energy given off, i.e. in modulation of the luminance of each of the sub-pixels. This luminance modulation is conventionally achieved by varying the supply current intensity of the sub-pixel concerned. In this way, the luminance of the pixel is determined by the sum of the currents flowing in the light emitters, whereas the color of the pixel depends on the luminance of its sub-pixels and therefore on the current distribution between the different sub-pixels. It is therefore known to modulate the current between the sub-pixels to modulate the color and luminance of the pixel.

Another control technique exists—by modulating the polarization time (PWM for Pulse Width Modulation). This technique consists in keeping the current constant for each sub-pixel. Modulation of the pixel color and luminance is then obtained by modulating the application time of the current of each sub-pixel.

These two techniques give rise to large energy losses as the white light emitted by each light emitter passes through the corresponding color filter. If the white light has a homogeneous distribution in each of the primary colors, when it passes through the color filter, two thirds of the light energy is absorbed by the filter to only let the color corresponding to the filter pass. Operation of the pixel with an acceptable luminance thereby involves the use of very high-luminance light emitters. In practice, a high luminance is obtained by using a high current, which results in a high energy consumption and reduction of the lifetime of the light emitters.

OBJECT OF THE INVENTION

The object of the invention is to provide a pixel control circuit that is easy to implement enabling the consumption of the pixel to be limited, its lifetime and/or luminance to be increased and a compact display system to be obtained.

This object is achieved by the appended claims and more particularly by the fact that the device comprises:

- a matrix of identical pixels with variable chromatic coordinates and luminances determined periodically during a predetermined refresh period, each pixel comprising a plurality of color sub-pixels,
- each color sub-pixel comprising a light emitter formed by an organic light-emitting diode and a color filter, the light emitters of all the sub-pixels being identical and having a variable emission spectrum according to their supply voltage and/or current,
- an addressing circuit associated with each sub-pixel and comprising at least one selection input, a control input of the power supply time and a control input of the power supply conditions of the sub-pixel,
- a display device control circuit connected to the plurality of addressing circuits, each sub-pixel of each pixel being supplied by a specific supply voltage and/or current according to the color of the sub-pixel for the emission spectrum of the light emitter of said sub-pixel to come close to the transmission spectrum of the associated color filter and a function of the chromatic coordinate and required luminance for the associated pixel, the control circuit being connected to the selection input of each addressing circuit by a specific selection line, to the control input of the power supply conditions by a specific power supply control line and to the supply time control inputs of all the addressing circuits associated with each sub-pixel color by a specific reset line of said sub-pixel color.

BRIEF DESCRIPTION OF THE DRAWINGS

Other advantages and features will become more clearly apparent from the following description of particular embodiments of the invention given for non-restrictive example purposes only and represented in the appended drawings, in which.

DESCRIPTION OF PREFERRED EMBODIMENTS OF THE INVENTION

Figure 1:
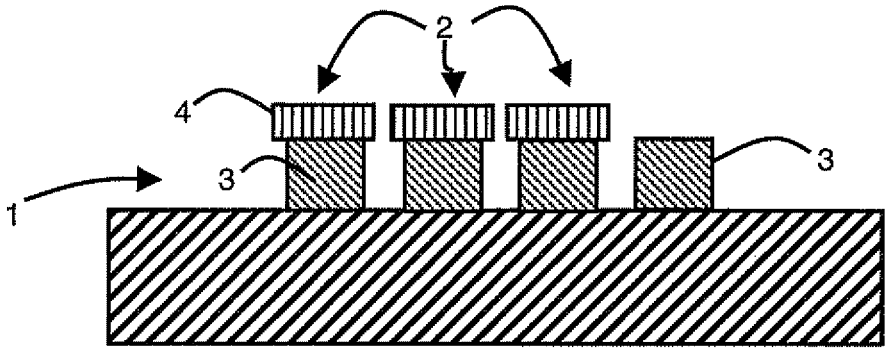
Figure 1 (prior art)
FIG. 1 schematically represents a pixel according to the prior art in cross-section, FIG. 2 schematically represents the displacement of the chromatic coordinates of an organic light-emitting diode versus its supply voltage, in a CIE1931 chromaticity diagram, FIG. 3 schematically represents the variation of the luminance versus the current density flowing through a sub-pixel for three different color filters, FIG. 4 schematically represents the variation of the luminance versus the wavelength for two current densities, FIGS. 5 to 8 schematically represent different alternative embodiments of a pixel addressing circuit according to the invention, FIG. 9 schematically represents a time distribution of the supply current of the sub-pixels of a pixel with a control circuit according to the invention, FIG. 10 schematically represents a particular embodiment of a display device according to the invention.

In conventional manner, pixel 1 with variable chromatic coordinates comprises a plurality of color sub-pixels 2, for example three color sub-pixels, is made from a continuous layer in which diode 3 emitting white light is formed. The light emitters of the sub-pixels, organic light-emitting diodes, are thus identical. Each color sub-pixel 2 is associated with a color filter 4 which only lets one of the primary colors pass to the outside. Color sub-pixels 2 used are for example sub-pixels having precise shades of blue, green and red. Pixel 1 can advantageously comprise an additional sub-pixel, without a color filter, which emits a white light to facilitate the realization and luminance of white.

Pixel 1 is associated with a control circuit which in particular enables the power supply conditions (voltage, current and application time) of each of the sub-pixels to be fixed independently via two sets of electrodes arranged on each side of the emitting layer. The circuit control thus enables the luminance and chromatic coordinate of pixel 1 to be determined periodically.

The emission spectrum of emitting layer 3, i.e. the color emitted by this layer, can vary with the power supply conditions (voltage, current) to a more or less great extent according to the composition of this layer. In general manner, this phenomenon has to be limited. On the contrary, according to the invention, it is advantageous to choose a composition that generates a significant variation of the emission spectrum with the polarization.

Figure 2:
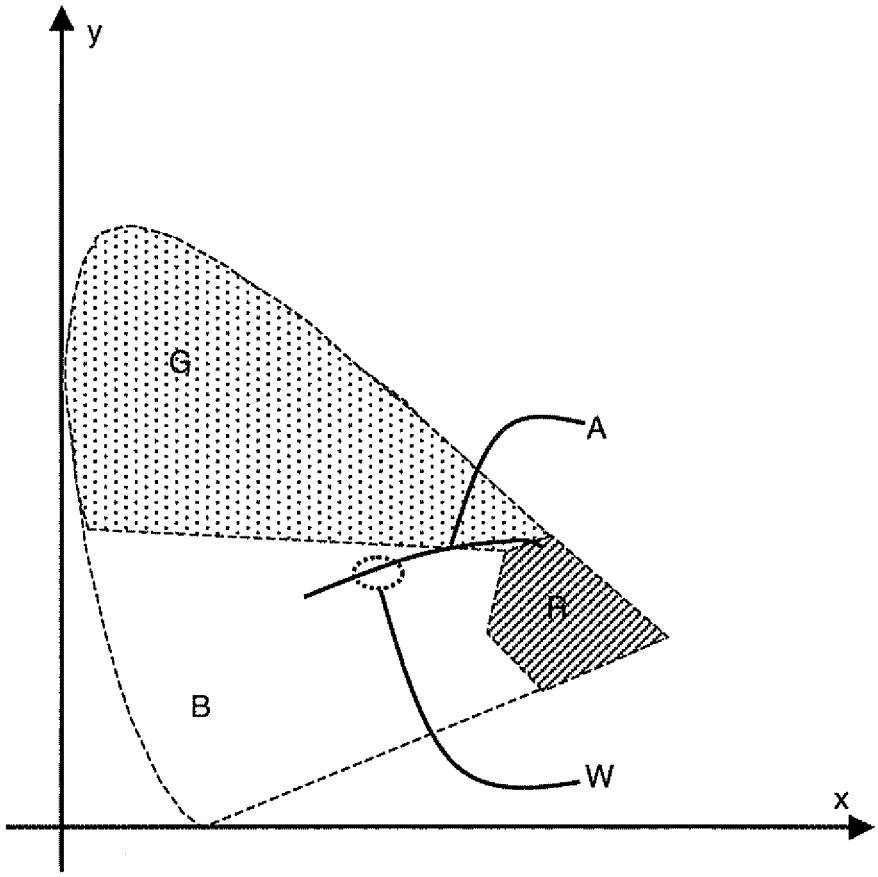

Thus, as illustrated in FIG. 2 by curve plot A, in a CIE1931 chromaticity diagram, the color emitted by an organic light-emitting diode 3 varies from red (R) to blue (B) passing via green (G) and white (W), when the supply current increases.

An organic diode light-emitting 3 in known manner comprises a light-emitting layer itself able to comprise at least two sub-layers made from emitting materials of different shades. The light-emitting layer advantageously presents one of the following schematic structures:

Anode/Blue emission sub-layer/Red emission sub-layer/Green emission sub-layer/Cathode.

Anode/Blue emission sub-layer/Green emission sub-layer/Red emission sub-layer/Cathode.

The latter structure in general procures the maximum variation of its emission spectrum with the polarization and will therefore be preferred for implementation of the invention.

Emission can be intrinsic to the materials chosen for making the sub-layers or be obtained by doping. Other stackings are possible based on multidoped layers, i.e. layers comprising at least two dopants which enable emission of the sub-layer considered in at least two colors. The following stackings can in particular be cited:

Anode/Blue emission sub-layer/Red and Green or Red and Yellow multidoped emission sub-layer/Cathode Anode/Red, Green and Blue multidoped emission sub-layer/Cathode.

Diode 3 can conventionally comprise additional layers, in particular associated with transport and/or confinement of the charge carriers in the structure, such as hole and/or electron restraining layers, buffer layers and hole and/or electron transport layers, necessary for correct operation of the latter. These layers are not dealt with explicitly for the sake of clarity.

Furthermore, the additional sub-pixel, devoid of a filter, is supplied under operating conditions called nominal operating conditions, to emit a white light.

Each organic light-emitting diode 3 of pixel 1 is supplied (current and/or voltage) independently from the others by the control circuit for each one to emit in the color corresponding to its own color filter 4. The voltage and/or current applied to each sub-pixel, and therefore to each light emitter, is determined according to the color of the sub-pixel. What is involved for example is to make the organic light-emitting diode 3 associated with the red color filter emit in the red band, diode 3 associated with the blue filter emit in the blue band and diode 3 associated with the green filter emit in the green band. The emission spectrum of each light-emitting diode 3 is thus close to the transmission spectrum of its color filter. Most of the light energy emitted by an organic light-emitting diode 3 thus passes through the corresponding color filter 4, which results in a large increase of the light output of pixel 1. The control circuit therefore controls light emitters 3 separately, which emitters have an emission spectrum that can be modulated according to their supply voltage and/or current. The supply voltage and/or current applied to each sub-pixel is then determined according to its color for its emission spectrum to be close to the transmission spectrum of color filter 4 associated thereto. The organic light-emitting diodes described above are particularly suitable in so far as their color varies greatly with the supply voltage and/or current. The luminance of each pixel is modulated by adjusting the application time of this current and/or of this voltage.

Organic light-emitting diode 3 associated with red color filter 4 is advantageously supplied by a lower current $I_R$ than the diodes associated with the blue and green filters, which enables a deep red to be obtained. In similar manner, organic light-emitting diode 3 associated with blue color filter 4 is advantageously supplied by a higher current $I_B$ than the diodes associated with the red and green filters, which enables a deep blue to be obtained.

For example purposes, an emitting layer made up from the following Blue/Green/Red emission sub-layers is considered: SEB010 doped SEB020 (with a thickness of about 10 nm)/TMM004 doped TEG341 (with a thickness of about 7 nm)/TMM004 doped TER040 (with a thickness of about 20 nm), all these materials being marketed by Merck.

Figure 3:
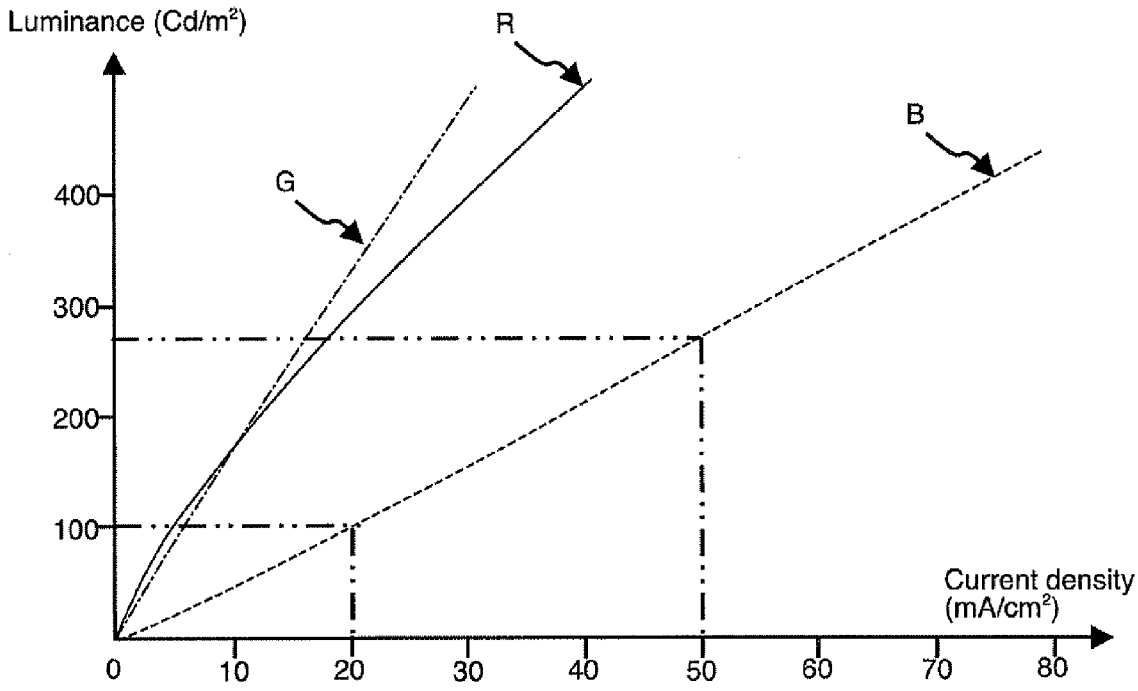

FIG. 3 details the luminance versus current density for three sub-pixels of different colors. Curve plots G, R and B represent the variation of the luminance with the current density for a diode respectively associated with a green, red and blue filter. For example purposes, for a diode associated with a blue filter, when the diode is supplied with a current density of 20 mA/cm$^2$, the luminance obtained for a frame time of 20 ms is 100 Cd/m$^2$. It is 250 Cd/m$^2$ for the same sub-pixel, i.e. the same diode/color filter pair, supplied with a current density of 50 mA/cm$^2$. The luminance being proportional to the application time of the current, to adjust the luminance to 100 Cd/m$^2$, the current simply has to be applied during a fraction of frame time t only, i.e.: $t \times 100/250$.

Figure 4:
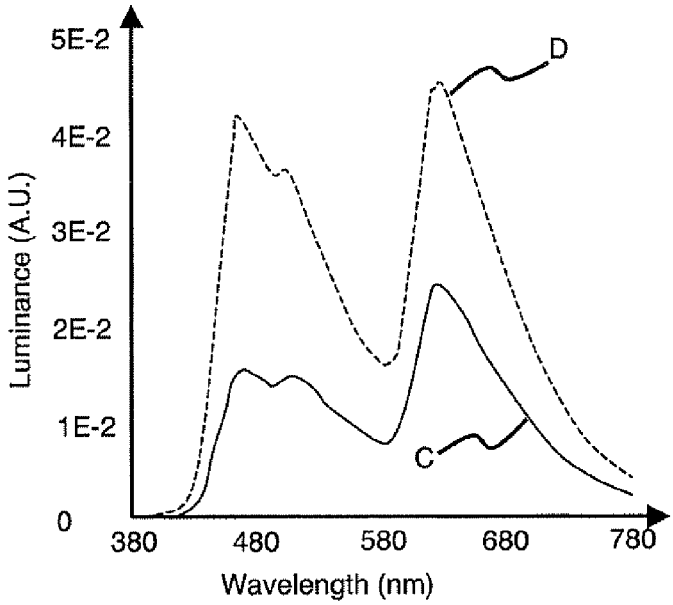

FIG. 4 represents the emission spectra of a diode that is supplied with two current densities: 50 and 20 mA/cm$^2$. Curve plots C and D represent the variation of the luminance versus the wavelength of the emission spectrum respectively for current densities of 20 mA/cm$^2$ and 50 mA/cm$^2$. If the two emission spectra of the diode are compared, it can be observed that the proportion of energy emitted in the blue band, i.e. between 450 and 495 nm, compared with the total energy increases when the current density increases. The losses at the level of the blue filter are therefore lesser than when the diode is polarized to 50 mA/cm$^2$, plot D. The luminance of the blue sub-pixel is then greatly increased when its polarization density is increased. Thus, as before, to obtain an identical luminance on the same diode polarized to 20 mA/cm$^2$ throughout frame time t, the diode then simply has to be supplied for a shorter period.

For each sub-pixel, the selection criteria of the currents to be used are dictated by the chromatic coordinates that are desired to be obtained for the sub-pixel in question and by the luminance obtained after filtering. The table below gives the luminance (in Cd/m$^2$) obtained after filtering and the chromatic coordinates (X, Y) in a CIE1931 chromaticity diagram, for a frame time t of 20 ms, according to the polarization (voltage/current pair) for the same diode.

| V | I | Luminance (Green) | Luminance (Red) | Luminance (Blue) | X | Y |
|---|---|---|---|---|---|---|
| 2.975 | 0.659 | 12.6175687 | 21.2840743 | 1.85441232 | | |
| 3.075 | 1.21 | 23.4090786 | 35.0653817 | 3.87144001 | | |
| 3.175 | 2.07 | 39.2788901 | 53.1572501 | 7.2437429 | | |
| 3.275 | 3.30 | 61.4091397 | 75.9675504 | 12.4416941 | | |
| 3.375 | 4.99 | 90.7088203 | 103.613592 | 19.9391214 | 0.66 | 0.33 |
| 3.475 | 7.13 | 126.969486 | 135.475569 | 29.8250871 | | |
| 3.575 | 9.78 | 170.623653 | 171.628165 | 42.4023372 | 0.28 | 0.6 |
| 3.675 | 13.1 | 223.836446 | 212.973066 | 58.4723248 | 0.28 | 0.599 |
| 3.775 | 16.9 | 286.26392 | 259.014261 | 78.023142 | 0.27 | 0.598 |
| 3.875 | 21.6 | 359.343857 | 310.43009 | 101.711398 | 0.266 | 0.596 |
| 3.975 | 27.1 | 445.507072 | 368.509646 | 130.565117 | 0.26 | 0.59 |
| 4.075 | 33.6 | 554.08549 | 432.988299 | 164.62027 | 0.25 | 0.59 |
| 4.275 | 50.0 | 796.948856 | 587.292835 | 254.149127 | | |
| 4.675 | 95.1 | 1446.65256 | 944.827876 | 496.6258 | | |
| 5.075 | 166 | 2410.45222 | 1422.65922 | 876.830878 | 0.08 | 0.39 |

According to this table, if a luminance equal to 100 Cd/m2 is required for the pixel, and therefore for each sub-pixel, the following characteristics are privileged:

- The red sub-pixel is supplied with a current density equal to 4.99 mA/cm2 during an application time corresponding to frame time t, for example 20 ms, a luminance of 100 Cd/m2 is then obtained after filtering.
- The blue sub-pixel is supplied with a current density equal to 166 mA/cm$^2$ during an application time equal to t×100/876 i.e. 2.3 ms. Indeed with this current density, the chromatic coordinates of the emitted light radiation are closest to the deepest blue, in the CIE representation.
- The green sub-pixel is supplied with a current density equal to 13.1 mA/cm$^2$ during an application time equal to t×100/223 i.e. 9 ms. With this current density, the chromatic coordinates of the emitted light radiation are closest to the required green, in the CIE representation.

In this manner, each diode is supplied under conditions under which obtaining an emission spectrum close to the transmission spectrum of the associated color filter is enhanced. The differences of light intensity of the diode which result from these polarization differences are modulated by the specific power supply times for each sub-pixel. Each of the sub-pixels thus presents the same luminance, here for example 100 Cd/m$^2$.

Figure 5:
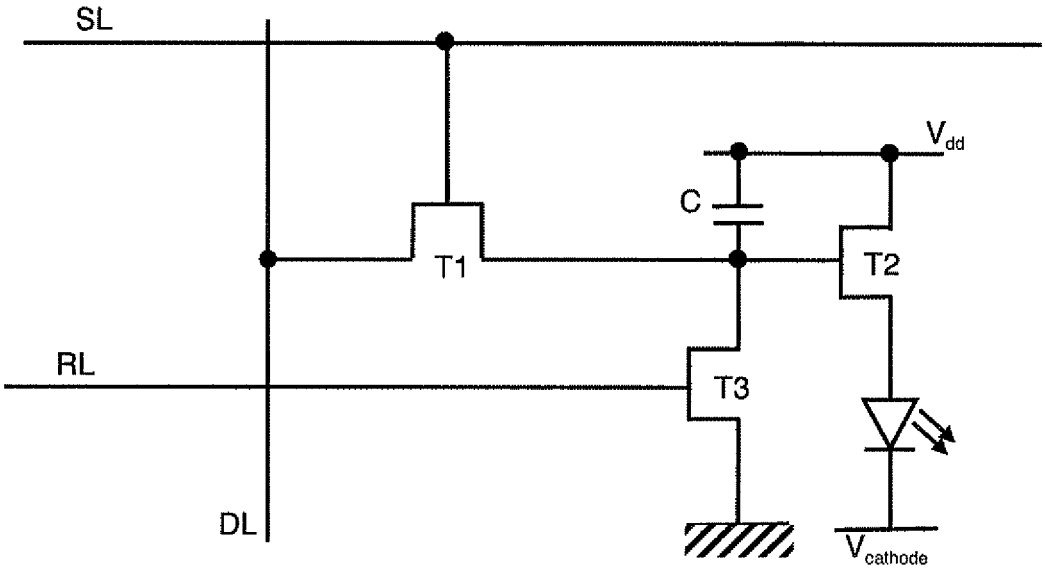

For example purposes, FIG. 5 illustrates a sub-pixel addressing circuit. In conventional manner, a first transistor T1, operating as a switch, is connected via its control electrode (gate) to a selection line (SL) for selecting the diode, i.e. the sub-pixel, to be activated. First transistor T1 is connected between a data line (DL) and the control electrode of a second transistor T2. When transistor T1 is on (the sub-pixel is selected), the voltage available on data line DL is available on the gate of transistor T2. Transistor T2 and diode 3 are connected in series and supplied between supply voltage $V_{dd}$ and a predefined potential $V_{cathode}$. Transistor T2 is connected to potential $V_{dd}$ whereas the diode is connected to potential $V_{cathode}$. The current level flowing in the transistor and in the diode is fixed by the voltage level applied on the gate of transistor T2. When transistor T1 is in off state, this voltage is kept constant by a capacitor C connected between power supply $V_{dd}$ and the gate of transistor T2. Capacitor C is charged when transistor T1 is in on state. In general, the pixel electrode, i.e. the electrode that is commanded by second transistor T2, corresponds to the anode of the light-emitting diode. In this case, the cathode is in general common to all the pixels and potential $V_{cathode}$ is fixed and constant. However, specific cathodes can also be provided by color (one cathode for each color and for the whole display device). These cathodes are independent and the current or voltage at the terminals of the different diodes can be modulated by controlling these different cathodes. The anode of each sub-pixel then remains controlled to a potential/current that is for example constant, as in the prior art. This solution presents the advantage of being able to keep a circuit identical to the prior-art device for the anode control circuit, at the level of each sub-pixel.

Practically, for each organic light-emitting diode 3 of pixel 1, the control circuit fixes the supply conditions (current and/or voltage) which allow optimum light efficacy with the corresponding color filter 4. For each organic light-emitting diode 3 of pixel 1, the control circuit for example fixes a current which defines the color emitted by the diode and also the instantaneous luminance of the latter.

Polarization of the diode having been chosen to optimize the emitted color, the luminance obtained is adjusted to the required luminance by adjusting the application time of this polarization: the diode is no longer supplied throughout frame time t.

For this, the addressing circuit of diode 3 comprises control means of the supply voltage and/or current application time according to the color of the sub-pixel.

For example purposes, the diode addressing circuit comprises a control transistor T3, operating as a switch, connected between the control electrode (gate) of second transistor T2 and the power supply source terminal connected to the diode, preferably ground. The control electrode (gate) of control transistor T3 is connected to a reset line (RL) which, with control transistor T2, forms control means of the current application time through diode 3.

When transistor T3 is off, the voltage on the gate of transistor T2 is maintained by means of capacitor C and the required current flows in diode 3. When transistor T3 is on, capacitor C discharges and the potential of the power supply source terminal connected to the diode (preferably ground) is transposed onto the gate of transistor T2, turning transistor T2 off: there is then no longer any current flowing in the diode.

Reset line (RL) and control transistor T3 thereby enable a maximum time to be fixed during which the diode is supplied during each frame period Δt. In this way, the control means of the supply condition (voltage/current) application time enable the mean luminance of each sub-pixel to be adjusted on the frame time, i.e. they enable a predetermined mean luminance to be obtained during a predetermined period.

In conventional manner, the control circuit periodically fixes the chromatic coordinates of pixel 1 and its luminance by modulating the luminances of the sub-pixels, for a frame period Δt, for example of 20 ms. Thus, at each beginning of period Δt, the control circuit selects the sub-pixels 2 necessary for obtaining the chromatic coordinates of the pixel and controls the luminance of each of these sub-pixels 2.

For a given luminance, control transistors T3 associated with sub-pixels of different colors are on during times $t_{on}$ which are dependent on this color ($t_{on} \leq \Delta t$) during each period Δt. The time takes account of the differences of instantaneous luminance existing between the different sub-pixels of one and the same pixel due to the differences of their supply voltage and/or supply current. To obtain a given mean luminance over a period Δt, the control circuit controls supply time $t_{on}$ of each of sub-pixels 2. The application time $t_{on}$ of the supply voltage or current can be adjusted by the anode or by the cathode.

Figure 6:
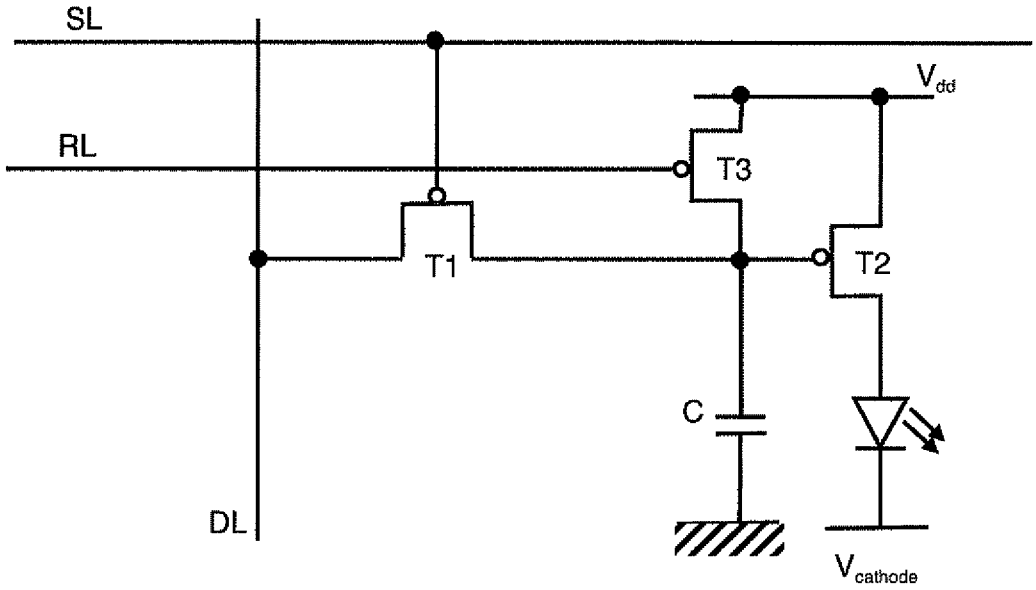

For example purposes, the addressing circuit illustrated in FIG. 5 and which operates in conjunction with the control circuit was produced using n-type transistors, but in like manner, a circuit could be achieved from a p-type transistor as illustrated in FIG. 6.

Figure 7:
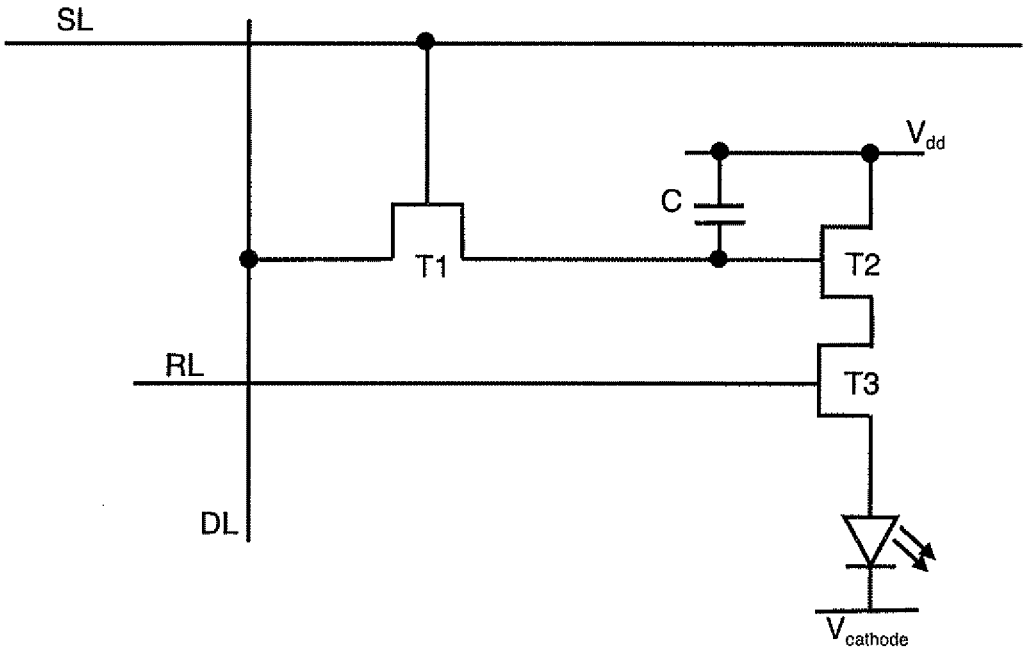
Figure 8:
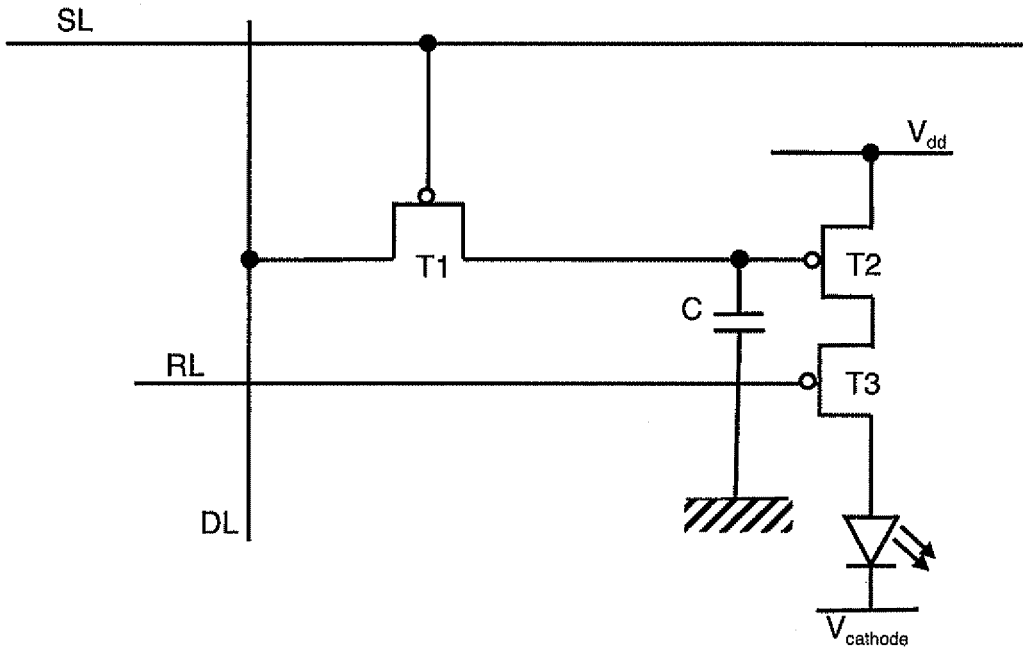

In alternative embodiments illustrated in FIGS. 7 and 8, transistor T3 can be connected in series with the diode so that, in the off state, it turns the current flowing in the diode off. It could also be connected in parallel with the capacitor.

Figure 9:
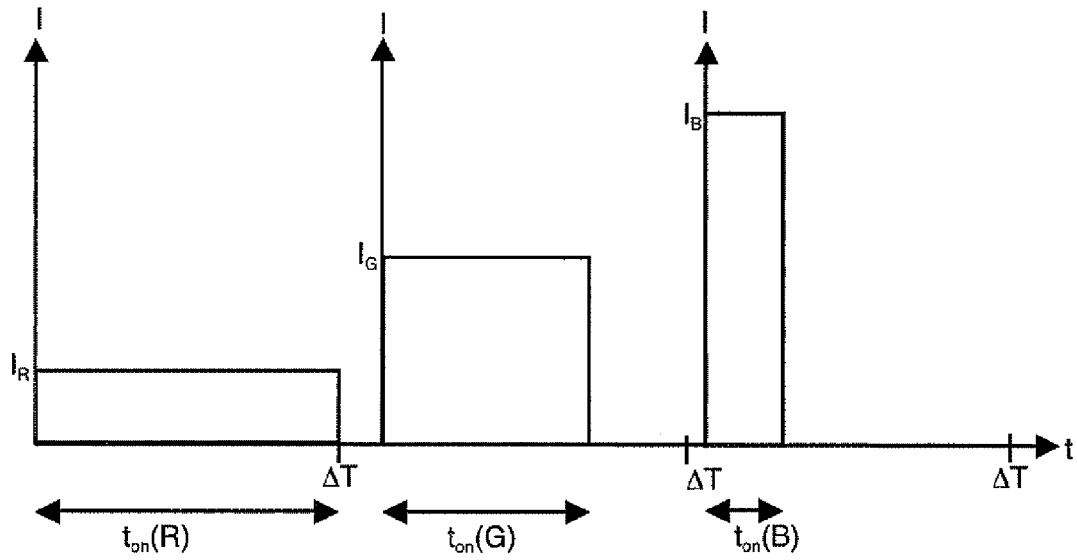

Thus, as illustrated in FIG. 9, diode 3 associated with the red filter is polarized with a weaker current than the other sub-pixels to obtain the maximum emission efficiency in the red band. To obtain a luminance of the red sub-pixel that is comparable with those of the other sub-pixels, it is chosen to polarize the diode during a longer time, for example throughout frame period Δt. In the opposite manner, diode 3 associated with the blue filter is polarized with a stronger current than the other sub-pixels to obtain the maximum emission efficiency in the blue band, and it can therefore be polarized during a shorter time. To obtain a luminance comparable with those of the other sub-pixels, it will be chosen to polarize the diode during a shorter time $t_{on}(B)$ than supply time $t_{on}(G)$ of the green sub-pixel, itself shorter than supply time $t_{on}(R)$ of the red sub-pixel.

Practically, the product of the instantaneous luminance L of the diode by its supply time ($L x t_{on}$) corresponds to the mean luminance of the sub-pixel over period Δt. The global luminance of pixel 1 then depends on the mean luminance of the different selected sub-pixels.

Thus, the supply voltage or current of each of organic light-emitting diodes 3 being fixed according to the color of the corresponding sub-pixel ($V_R$, $V_G$, $V_B$ or $I_R$, $I_B$, $I_G$), the color of pixel 1 and its luminance are determined by the control circuit by selecting the appropriate sub-pixels (command SL of FIG. 3) and modulation of supply time $t_{on}$ of each of color sub-pixels 2.

As illustrated in FIG. 9, the supply times of the blue, green and red diodes are increasing ($t_{on}(B) < t_{on}(G) < t_{on}(R)$) during period Δt, supply of each color sub-pixel 2 being able to be constituted by a single pulse having a time ($t_{on}$) in high state that is fixed by control circuit RL signals.

The invention is not limited to the embodiments described above. In particular, the addressing circuit of FIGS. 5 to 8 can be replaced by any circuit enabling the supply voltage and/or current of a color sub-pixel to be adjusted so that its emission spectrum is close to the transmission spectrum of the color filter of the sub-pixel, and whereby supply time $t_{on}$ of the diode can be adjusted according to the color of the sub-pixel to obtain a predetermined mean luminance during a predetermined period Δt.

In another particular embodiment, the display system also called display device comprises a matrix of pixels 1 that is identical to the foregoing embodiments. The display device also comprises an addressing circuit specific to each sub-pixel 2 in order to select the required sub-pixel 2 and to control its supply time and supply conditions. This specific addressing circuit can be the one represented for example in FIGS. 5 to 8. The display device as in the foregoing comprises a control circuit which cooperates with the different addressing circuits of the matrix of pixels 1 to obtain the desired image both as far as the colors and the grey levels are concerned. The control circuit manages the set of sub-pixels 2 of the matrix so as to emit the desired image.

Each addressing circuit of sub-pixel 2 comprises a reset terminal which controls the supply time of sub-pixel 2, i.e. the supply time of light-emitting element 3. Each addressing circuit also comprises a selection terminal enabling it be defined whether the light-emitting element 3 of sub-pixel 2 has to be supplied with current or not. Each addressing circuit further comprises a power supply control terminal which enables the supply conditions of sub-pixel 2 to be modulated. As explained in the foregoing, the cathode can be common to sub-pixels of a determined color, and therefore to a group of sub-pixels 2, or the cathode can be specific to each sub-pixel 2.

As in the foregoing embodiments illustrated in FIGS. 5 to 8, the selection input of sub-pixel 2 can be formed by the control terminal of a first transistor T1. According to the value of associated selection line SL, first transistor T1 is in on or off state, which has the effect of allowing a current to flow in light emitter 3 of sub-pixel 2 or not.

The control input of the supply conditions of sub-pixel 2 can be formed by an input terminal of first transistor T1, the output terminal whereof is connected to the control terminal of second transistor T2. In this way, depending on the value applied on the control line, also called data line DL, second transistor T2 modulates the quantity of current that can be applied on light emitter 3. Modulation of the current in light emitter 3 is only effective if first transistor T1 is in on state.

The reset input of sub-pixel 2 can be formed by the control input of third transistor T3 which is connected between the control input of second transistor T2 and ground or supply voltage $V_{dd}$. In this way, depending on the voltage applied on the control terminal of third transistor T3, second transistor T2 is in an off state or an on state.

In this embodiment which is particularly advantageous as it is compact, the different addressing circuits associated with a color sub-pixel 2, i.e. with a color of color filter 4, are connected to the same reset line RL. The control circuit is connected to all the sub-pixels 2 by means of their respective addressing circuits. The control circuit is connected independently to each sub-pixel 2 by a specific selection line SL and by a specific supply condition control line DL. The control circuit is also connected to the different sub-pixels 2 by reset lines RL which fix supply time $t_{on}$ of sub-pixel 2. However, these specific reset lines are dedicated to a color of sub-pixel 2. The control circuit therefore comprises as many reset lines RL as there are sub-pixels 2 of different colors in a pixel 1. The same is the case for the reset inputs in a pixel 1. On the contrary, the control circuit comprises as many selection lines SL and supply condition control lines DL as there are sub-pixels 2 in the matrix. In this way, the quantity of independent lines in the display device can be reduced, while at the same time ensuring independence of use of the different sub-pixels 2 and enhanced energy performances. Reset line RL can be physically common to all the sub-pixels of the same color. This can be the case for example when the reset line is connected to the anode or to the cathode of a diode.

In general manner according to the different addressing circuits illustrated in FIGS. 5 and 6, first transistor T1 is connected between supply condition control line DL and the control electrode of second transistor T2. Diode 3 of sub-pixel 2 considered is connected in series with second transistor T2 between supply voltage $V_{dd}$ and predefined cathode potential $V_{cathode}$. Capacitor C and third transistor T3 are connected in series between supply voltage $V_{dd}$ and ground. The common terminal of capacitor C and of third transistor T3 is connected to the control terminal of second transistor T2 and to first transistor T1. Reset line RL is connected to a control electrode of third transistor T3. The control terminal of first transistor T1 is for its part connected to selection line SL.

As far as the addressing circuits illustrated in FIGS. 7 and 8 are concerned, first transistor T1 is connected between supply condition control line DL and the control electrode of second transistor T2. Diode 3 of considered sub-pixel 2 is connected in series with second transistor T2 and third transistor T3 between supply voltage $V_{dd}$ and the predefined potential $V_{cathode}$ applied to the cathode, Capacitor C is connected between supply voltage $V_{dd}$ and the control terminal of second transistor T2 or between ground and the control terminal of second transistor T2. Reset line RL is connected to the control electrode of third transistor T3. The control terminal of first transistor T1 is for its part connected to selection line SL. In this configuration, the relative position of second T2 and third T3 transistors between the diode and supply voltage Vdd is not important.

Figure 10:
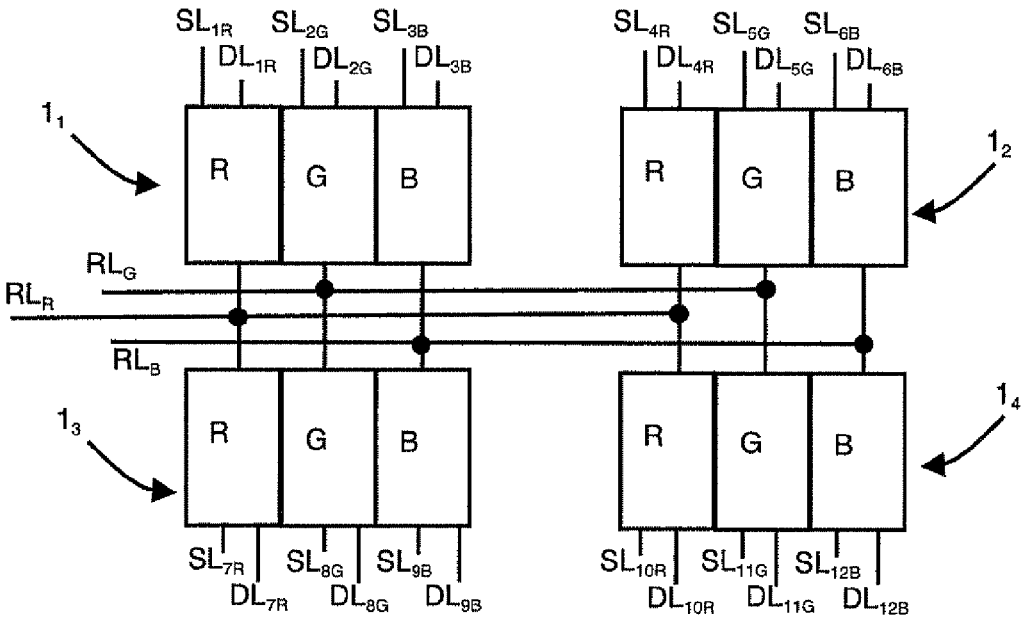

For example purposes illustrated in FIG. 10, the matrix of pixels 1 comprises four pixels $\mathbf{1}_1$, $\mathbf{1}_2$, $\mathbf{1}_3$ and $\mathbf{1}_4$ which are each constituted by three sub-pixels 2 called blue "B", green "G" and red "R". The control circuit comprises a single reset line $RL_R$ associated with the red sub-pixels, a single reset line $RL_G$ associated with the green sub-pixels and a single reset line $RL_B$ associated with the blue sub-pixels. The control circuit also comprises as many selection lines as sub-pixels (here twelve selection lines $SL_1$-$SL_{12}$) and as many control lines as sub-pixels (here twelve control lines $DL_1$-$DL_{12}$)

As reset line RL controls the supply time of sub-pixels 2 of the same color, all the red sub-pixels are supplied during a first predetermined time $t_{on(R)}$, all the green sub-pixels are supplied during a second predetermined time $t_{on(G)}$ and all the blue sub-pixels are supplied during a third predetermined time $t_{on(B)}$. The different sub-pixels 2 are supplied on the condition that first transistor T1 is in on state, i.e. that they have been selected to emit light. In this way, a sub-pixel 2 is supplied if the information on its selection line SL authorizes this and sub-pixel 2 is then only supplied during the time that is defined by reset line RL.

In this particular embodiment, modulation of the luminance of each sub-pixel 2 and therefore of pixel 1 is achieved by modulating the supply voltage at the terminals of each sub-pixel 2. Indeed, as specified in the foregoing, according to the supply conditions of each diode 3, modulation of the emitted color, but also of the instantaneous luminance, is performed. For a given supply condition, there are therefore a predefined color and a predefined instantaneous luminance. Modulation of the luminance for a given color is therefore performed by modulating the supply conditions for each of the sub-pixels 2. Each sub-pixel 2 naturally remains supplied in a range such that the emitted color is close to that of the associated color filter 4 so as to preserve an energy interest for this architecture. The color emitted by sub-pixel 2 is defined by the intersection between the transmission spectrum of the color filter and the emission spectrum of light-emitting element 3.

In a display device comprising this control circuit associated with a plurality of identical pixels 1 with variable chromatic coordinates with sub-pixels 2 and their associated addressing circuit, the operating conditions are fixed in the following manner.

In a pixel 1, each sub-pixel 2 (each light emitter 3) is supplied according to different conditions to determine the most energetically favorable supply conditions with the associated color filter 4 of sub-pixel 2. In this way, light emitter 3 of each sub-pixel 2 presents an emission spectrum which is as close as possible to the transmission spectrum of the associated color filter.

Depending on the supply conditions retained for each sub-pixel 2, the latter present different instantaneous luminances from one another. Each sub-pixel 2 is then supplied according to a specific predetermined time so that the corresponding pixel 1 emits a predetermined color and luminance. Typically, the supply times of each of the sub-pixels are chosen such that the pixel emits a white color under the most favorable supply conditions between each light emitter 3 and color filter 4 that is associated thereto.

Reset lines RL being associated with a sub-pixel color, all the sub-pixels of the same color normally have the same supply times. This means that all the pixels emit a white light when they are supplied under their most favorable supply condition with their color filter. In order for the different pixels to emit colors and luminances which are proper to them, each sub-pixel is supplied under different conditions (voltage and/or current). In this embodiment, modulation of the characteristics of the radiation emitted by the pixel is achieved by modulating the supply conditions of the sub-pixels which compose the latter.

In an alternative embodiment where the pixel electrode (the electrode commanded by transistor T2) represents the anode of the light-emitting diode, the cathode is common to all the sub-pixels of the same color, and control of the supply time can then be performed by means of the cathode. In this particular case, the reset line is formed by the cathode common to all the sub-pixels of the same color. This reset results in the appearance of a lower potential difference than a threshold voltage at the terminals of diode 3. It does in fact have to be considered that the anode control voltage can vary according to the displayed level, and a constant voltage at the terminals of the diode can therefore not be guaranteed. The use of a threshold voltage is then very advantageous. In this embodiment, it is possible to control the supply conditions of each of the diodes independently by means of second transistor T2. In the case where the pixel electrode represents the cathode of the light-emitting diode, it is also possible to perform the same modulation by means of the anode which is the common to all the sub-pixels of the same color. In these two particular embodiments, third transistor T3 can be eliminated.

Thus, if two pixels emit different colors and/or luminances, the only difference that exists between these two pixels is related to the supply conditions of each of the sub-pixels in each pixel.

The invention claimed is:

1. A display device comprising:

a matrix of identical organic light-emitting diodes with variable chromatic coordinates and luminance, an emission spectrum of a diode of the organic light emitting diodes being variable depending on supply conditions, a plurality of colored filters, a colored filter being associated with the diode to form a colored sub-pixel, an addressing circuit associated with each sub-pixel with a control input of the supply time and a control input of the supply conditions of the sub-pixel and one selection input, and a control circuit of the display device connected to:

a control input of supply power conditions by a supply control line specific to each sub-pixel for adjusting the emission spectrum in order to approximate a transmission spectrum of the associated colored filter and to adjust an instant luminance of the sub-pixel, a control input for setting the supply duration of each addressing circuit by a reset line in order to adjust a mean luminance of the diode during a first period, the reset line being common to all sub-pixels of a same color, a selection input of each addressing circuit by a specific selection line in order to define if the diode of the sub-pixel has to be supplied or not.

2. Device according to claim 1, wherein the reset line is connected to all sub-pixels of a same colour via a cathode of each sub-pixel diode.

3. Device according to claim 1, wherein the reset line is connected to all sub-pixels of a same colour via an anode of each sub-pixel diodes.

4. Device according to claim 1, wherein:

a first transistor is connected between the supply power control line and a control electrode of a second transistor, the sub-pixel diode is connected in series with the second transistor between a supply voltage and a predefined potential, a capacitor and a third transistor are connected in series between said supply voltage and ground, said capacitor and the third transistor having a common terminal connected to the control terminal of the second transistor and to the first transistor, the reset line is connected to a control electrode of the third transistor, and a control terminal of the first transistor is connected to a selection line.

5. Device according to claim 1, wherein:

a first transistor is connected between the supply power control line and a control electrode of a second transistor, the sub-pixel diode is connected in series with second and third transistors between a supply voltage and a predefined potential, a capacitor is connected between said supply voltage or ground and the control terminal of the second transistor, the reset line is connected to a control electrode of the third transistor, and a control terminal of the first transistor is connected to a selection line.

6. Device according to claim 1, wherein the organic light-emitting diode comprises a stack: anode/blue emission sub-layer/green emission sub-layer/red emission sub-layer/cathode.

7. Device according claim 1, wherein a red sub-pixel is supplied with a weaker current than a green sub-pixel, itself supplied with a weaker current than a blue sub-pixel.

8. Device according to claim 1, wherein the organic light-emitting diode comprises a stack: anode/blue emission sub-layer/red emission sub-layer/green emission sub-layer/cathode.

* * * * *